US010307022B1

(12) United States Patent
Cole

(10) Patent No.: US 10,307,022 B1
(45) Date of Patent: Jun. 4, 2019

(54) TOWEL CADDY HOOK WITH FRICTIONAL ATTACHMENT

(71) Applicant: Leigh Cole, San Diego, CA (US)

(72) Inventor: Leigh Cole, San Diego, CA (US)

( * ) Notice: Subject to any disclaimer, the term of this patent is extended or adjusted under 35 U.S.C. 154(b) by 0 days.

(21) Appl. No.: 15/816,922

(22) Filed: Dec. 6, 2017

(51) Int. Cl.
*A47K 10/00* (2006.01)
*A47K 10/12* (2006.01)
*A63B 57/20* (2015.01)

(52) U.S. Cl.
CPC ..... *A47K 10/12* (2013.01); *A63B 57/20* (2015.10)

(58) Field of Classification Search
CPC ..... A47K 10/12; A63B 57/20
See application file for complete search history.

(56) References Cited

U.S. PATENT DOCUMENTS 978,734 A * 12/1910 Gordon ..... F21L 19/003 248/304
3,659,319 A * 5/1972 Erickson ..... D05B 51/00 24/304
4,195,807 A * 4/1980 Llauge ..... F16L 3/10 174/175
4,605,190 A * 8/1986 Kamp ..... A45B 1/00 248/229.26
5,054,726 A * 10/1991 Mattox ..... A47G 23/0225 248/206.5
5,409,190 A * 4/1995 Mattox ..... A47C 7/68 248/206.5
D358,083 S 5/1995 Pate
D421,712 S 3/2000 Brown et al.
6,062,521 A 5/2000 Kelley et al.
6,273,279 B1 8/2001 Wolf
6,427,952 B2 * 8/2002 Caveney ..... F16L 3/23 248/68.1
D473,449 S * 4/2003 Wu ..... D8/356
7,350,756 B2 4/2008 Woltmann et al.
D668,135 S 10/2012 Goodman et al.
9,307,855 B2 * 4/2016 Widess ..... A47G 25/12
2015/0232040 A1 8/2015 Wirtjes

* cited by examiner

*Primary Examiner* — Anita M King
(74) *Attorney, Agent, or Firm* — Law Office of Scott C Harris, Inc

(57) ABSTRACT

A hook with two curved portions collectively forming an openable pressure surface.

14 Claims, 2 Drawing Sheets

TOWEL CADDY HOOK WITH FRICTIONAL ATTACHMENT

BACKGROUND

Many different kinds of hooks and towel holders are known. A problem with these hooks and towel holders, however, is that the towels (or other similarly held items), can slip off of the hook. This becomes especially problematic when the hook is on a moving device. This is especially the case, for example, when the hook is attached to a golf cart.

A towel holder for a golf cart is shown in U.S. Pat. No. 6,273,279. While this hook can hold the towel, the towel can easily slide off the hook.

SUMMARY

The present application describes a frictional holder which secures a towel or other item using a frictional channel that inhibits the object being held from slipping off of the hook. One application of this system is in a golf cart. The hook can also be used in any other application where the hook or towel holder is actually moved or moving.

The frictional channel holder secures the towel while providing the ability to quickly and easily remove and replace the towel. Rather than snaps, hooks, magnets, hook and loop or other type clips, the present embodiment creates a pressure channel that restricts the object to be hung, from slipping off of the hook and allows the object to be hung to be held within a cavity.

DETAILED DESCRIPTION

Figure 1:
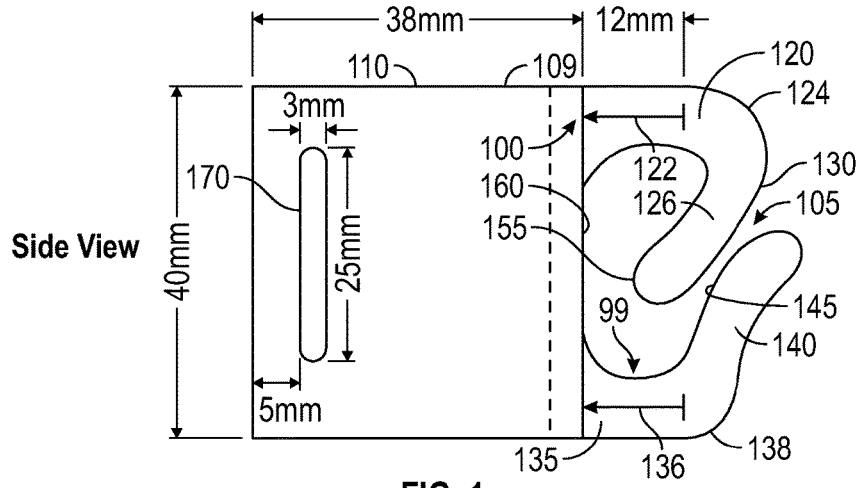
FIG. 1 shows a side view of the hook with pressure channel, showing the pressure channel formed between the two arms, one extending arm and one inwardly curving arm.
Figure 2:
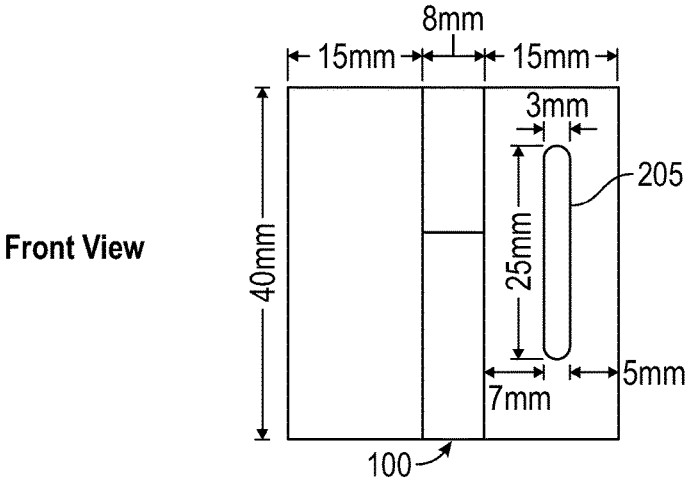
FIG. 2 shows a front view showing the hook from the front.

An embodiment describes an object holding hook 100 with a pressure channel 105 that forms a gateway to an object holding surface 99. The object holding hook 100 is connected to a connection part 110 that connects to a support structure, as explained herein. In one embodiment, the support structure can be a golf cart, but other support structures can alternatively be used according to the embodiments.

The object holding hook 100 is formed generally of a top curved portion 120 which attaches to the top of the connection part 110 and extends away from the connection part 110 for a length 122, to curve back at surface 124 down back to a first pressure arm 126. The end of the first pressure arm 126 faces back towards the connection part 110. The outermost surface 130 of the first pressure arm 126 forms a first surface of the pressure channel 105.

The bottom portion 135 of the object holding hook 100 attaches to the bottom portion of the connection part 110 and extends by a distance 136 from the connection part 110. The bottom portion 135 also has a curved part 138 that starts after the distance 136, which curves upward toward the top curved portion 120. The curved part 138 extends along an arm 140 that forms a second pressure area 145 that forms the second surface of the pressure channel opposing the first surface 130 of the pressure channel.

In one embodiment, the distances 122 and 136 are substantially the same distance.

The first pressure area/surface 130 is a first curved surface extending from the top area of the connection part in a first curved direction. The second pressure area/surface 145 is a second curved surface extending from the bottom area of the connection part in a second curved direction.

In an embodiment, as shown the first arm 120 is even with the first edge 109 of the securing part and the second arm 140 has a side even with the second edge of the securing part. This can avoid any extra bumps and make a more even hook surface.

The pressure channel 105 is formed between the surfaces 130 and 145.

In one embodiment, the hook material is formed of a deformable plastic material such as nylon. There is approximately a 2 mm gap between the first surface 130 of the pressure channel 105 and the second pressing surface 145 of the pressure channel 105. This 2 mm gap can, however, be pressed open by deforming either or both of the arms 126, 140. The first arm 126 can be deformed inward towards the connection part 110 and also the second arm 140 can be deformed away from the connection part to further open the area. The object to be held is then pushed or pulled in between the surfaces 130 and 145 of the arms 126, 140. Alternatively, the object to be held can be pushed or pulled between the distal end 155 of the first pressure area 126, and the back surface 160 of the connection part 110. The object to be held is pushed or pulled between the surfaces 130 and 145 of the arms 126, 140 to be held in the area 99.

The object to be hung is either pushed or pulled through the pressure channel, slightly deforming one arm or both arms of the plastic hook, and held in area 99. The object to be hung can easily be taken off the hook, but the pressure channel prevents the object from slipping off of the hook, keeping it in area 99.

Alternatively, the hook can be made of metal as long as the metal is deformable metal such as aluminum. In one embodiment, the hook can be made of nylon.

The hook itself is connected to the connection part 110. The connection part in this embodiment is a right angle, having a first slot 170 on one arm of the right angle, and having a second slot 205 on another arm of the right angle. These two slots form surfaces which can be used to carry a strap such as a VELCRO™ strap.

The connection part in one embodiment is formed of a right angle portion, having a first portion extending in a first direction in the same plane as the hook, a second portion extending perpendicular to the first portion, where both said first and second portions include slots thereon. The slots are of a size adapted to hold a strap therein, like the VELCRO™ strap mentioned above.

Figure 3:
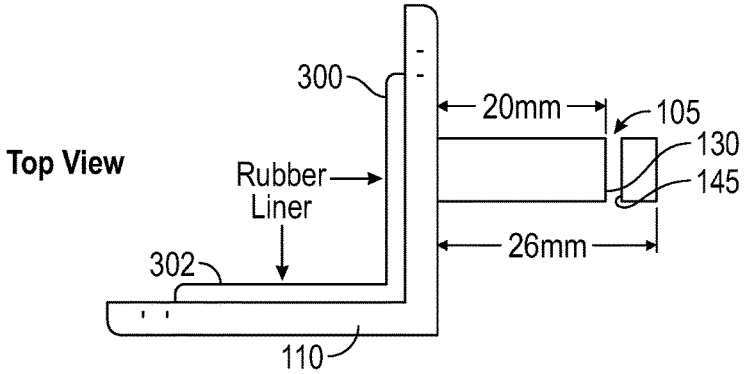
FIG. 3 shows a top view, showing the pressure channel.

FIG. 3 shows a top view of the pressure hook, showing the pressure channel 105 formed between the surface 130 and the surface 145. The holder in this embodiment is seen as the right angle portion. This right angle portion on the holder 110 may be covered with a nonslip rubber liner 300, 302 which tends to hold the holder 110 in place once mounted.

In this embodiment, the hook can be mounted to any kind of surface using tape, elastic, or a hook and loop fastener. In another embodiment, however, the holding part 100 can be mounted permanently on a surface, e.g. with screws or the like.

In operation, the pressure channel keeps the object to be held from slipping off, because the object, such as a towel is pushed between two surfaces of the pressure channel and rests on the upper surface 99 of the bottom portion 135.

Figure 4:
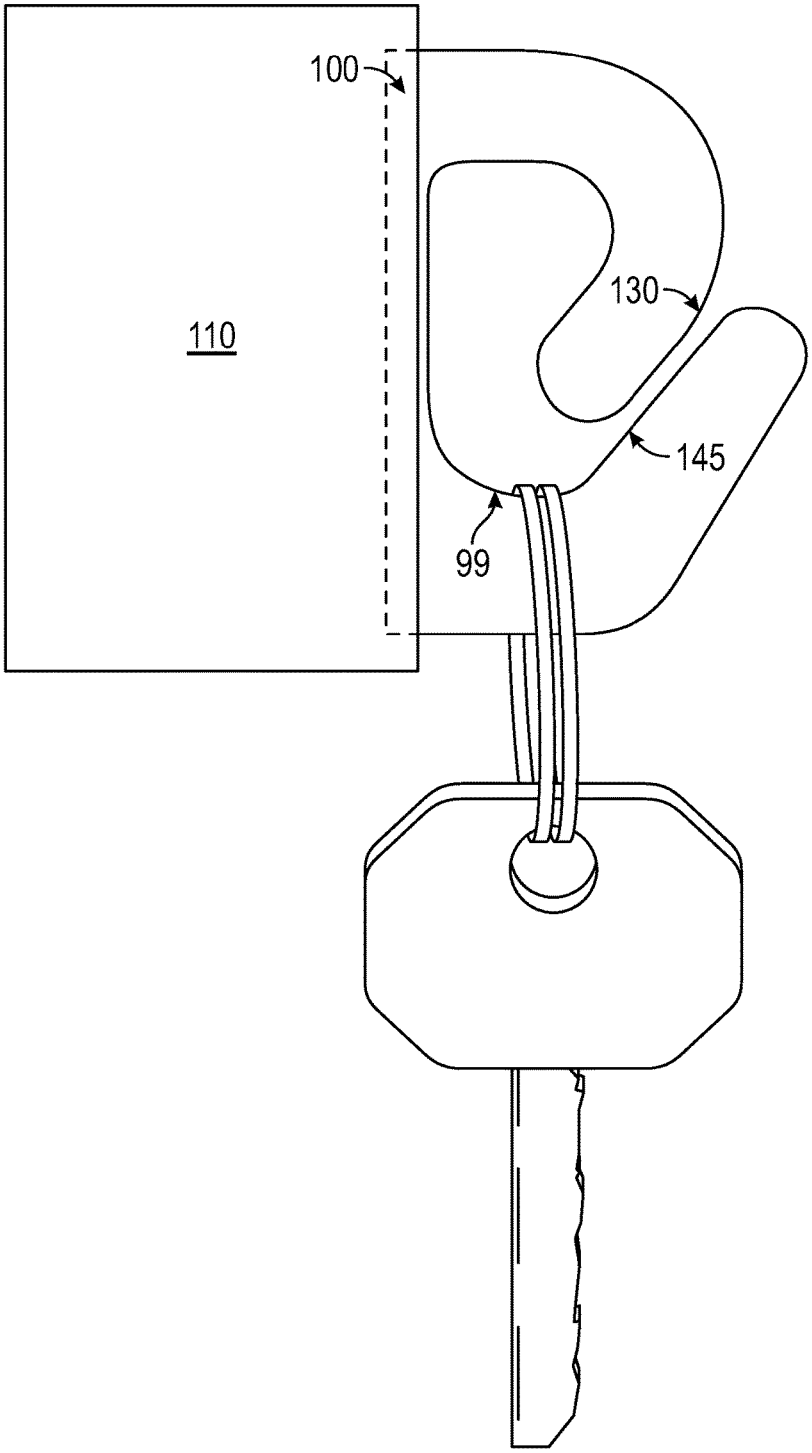
FIG. 4 shows how an alternative item can be hung from the hook.

FIG. 4 shows an embodiment, showing the hook 100 holding a keychain on the surface 99.

While the preferred embodiments have been shown and described, it will be understood that there is no intent to limit the invention by such disclosure, but rather, is intended to cover all modifications and alternate constructions falling within the spirit and scope of the invention.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments, which might be predictable to a person having ordinary skill in the art. For example, other shapes or other variety of surfaces could be used. This system could be used in vehicles, e.g., delivery trucks, or construction vehicles.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value might be increased or decreased by any amount, so long as it maintains the integrity of the hook 100, while still staying within the teachings of the present application, unless some different range is specifically mentioned. The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An object holding device, comprising:

a securing part, having a connection part operable to attach to a support structure;

a first securing arm, attached to and extending from the securing part, the first securing arm connected to a first section of the securing part and extending away from the securing part for a first distance, and after the first distance, the first securing arm having a curved portion which curves the first securing arm back towards the securing part, and a portion of the curved portion forming a first securing surface;

a second securing arm, also extending from the securing part, said second securing arm extending from the securing part by a second distance and after the second distance, the second securing arm having a curved portion curving towards the first securing arm, a portion of the curved portion forming a second securing surface facing towards the first securing surface and the second securing surface spaced from the first securing surface by a distance, where both the first securing arm and the second securing arm are formed of a deformable material, the first securing surface and the second securing surface forming a pressure channel between the first securing surface and the second securing surface, and where the first securing surface and the second securing surface are movable away from one another to open an area between the first securing surface and the second securing surface, wherein the securing part includes a first portion extending in a first direction in the same plane as the first and second securing part arms, a second portion extending in a second direction in a different plane as the first and second securing part arms, and where both the first portion and the second portion of the securing part respectively having surfaces defining first and second holes for receiving a strap to attach the securing part to a support.

2. The device as in claim 1, wherein inside surfaces of both the flat surface, and the attachment surface, have an elastomeric liner thereon.

3. The device as in claim 1, wherein the first and second holes are elongated slots to fit a strap.

4. An object holding device, comprising:

a securing part, having a connection part operable to attach to a support structure;

a first securing arm, attached to and extending from the securing part, the first securing arm connected to a first section of the securing part and extending away from the securing part for a first distance, and after the first distance, the first securing arm having a curved portion which curves the first securing arm back towards the securing part, and a portion of the curved portion forming a first securing surface;

a second securing arm, also extending from the securing part, said second securing arm extending from the securing part by a second distance and after the second distance, the second securing arm having a curved portion curving towards the first securing arm, a portion of the curved portion forming a second securing surface facing towards the first securing surface and the second securing surface spaced from the first securing surface by a distance, where both the first securing arm and the second securing arm are formed of a deformable material, the first securing surface and the second securing surface forming a pressure channel between the first securing surface and the second securing surface, and where the first securing surface and the second securing surface are movable away from one another to open an area between the first securing surface and the second securing surface, wherein the securing part is formed of a right angle portion, having a first portion extending in a first direction in the same plane as the object holding device, a second portion extending perpendicular to the first portion, where both said first and second portions include slots thereon, the slots of a size adapted to hold a strap therein.

5. The device as in claim 4, wherein there is a holding surface formed on the second securing arm, the holding surface holding an item which has passed between the pressure channel between the first securing surface and the second securing surface.

6. The device as in claim 4, wherein the first securing arm is located at a first distal edge of the securing part, and the second securing arm is located at a second distal edge of the securing part.

7. The device as in claim 4, wherein the first and second distances are substantially the same.

8. The device as in claim 4, wherein the object holding device is a hook which is formed of deformable plastic.

9. The device as in claim 4, wherein the object holding device is a hook that is formed of nylon.

10. The device as in claim 4, wherein the object holding device is a hook that is formed of metal.

11. The device as in claim 4, wherein said first portion of said right angle portion and said second portion of said right angle portion include a nonslip liner thereon.

12. The device as in claim 4, wherein the pressure channel forms a gap of approximately 2 mm between the first securing surface and the second securing surface when under formed, and can be deformed to open to a distance more than 2 mm.

13. The device as in claim 4, wherein said first securing arm curves toward the securing part, and the second securing arm curves away from the securing part.

14. The device as in claim 13, wherein the second securing arm forms a holding channel at a bottom most portion of its inside surface.

* * * * *